United States Patent [19]

Wakalopulos

[11] Patent Number: 4,910,435

[45] Date of Patent: Mar. 20, 1990

[54] REMOTE ION SOURCE PLASMA ELECTRON GUN

[75] Inventor: George Wakalopulos, Danville, Calif.

[73] Assignee: American International Technologies, Inc., Torrance, Calif.

[21] Appl. No.: 222,127

[22] Filed: Jul. 20, 1988

[51] Int. Cl.[4] ..... H01J 7/24; H01J 17/26; H01J 61/28; H05B 31/26

[52] U.S. Cl. ..... 315/111.31; 315/111.81; 315/111.91; 313/231.31; 313/363.1

[58] Field of Search ..... 313/231.31, 363.1; 315/111.21, 111.31, 111.81, 111.91

[56] References Cited

U.S. PATENT DOCUMENTS

| | | | |
|---|---|---|---|
| 2,285,622 | 6/1942 | Slepian | 250/84 |
| 3,566,185 | 2/1971 | Gavin | 315/111 |
| 3,970,892 | 7/1976 | Wakalopulos | 315/111.3 |
| 4,025,818 | 5/1977 | Giguere et al. | 315/337 |
| 4,163,172 | 7/1979 | Loda | 315/111.81 |
| 4,344,019 | 8/1982 | Gavin et al. | 315/111.81 |
| 4,447,773 | 4/1984 | Aston | 315/111.31 |
| 4,642,522 | 2/1987 | Harvey et al. | 315/111.31 |
| 4,645,978 | 2/1987 | Harvey et al. | 315/111.81 |
| 4,694,222 | 9/1987 | Wakalopulos | 315/111.21 |
| 4,707,637 | 11/1987 | Harvey | 315/111.31 |
| 4,755,722 | 7/1988 | Wakalopulos | 315/111.31 |

OTHER PUBLICATIONS

D. Pigache et al., "Secondary Emission Electron Gun for High Pressure Molecular Lasers", J. Vac. Sci. Technol., 12, No. 6, Nov./Dec., 1975, pp. 1197–1199.

G. Wakalopulos et al., "Wire-Ion-Plasma (WIP): A Revolutionary New Technology for E-Beam Curing", Conference Proceedings Finishing '83, Society of Manufacturing Engineers, Dearborn, Mich., (1983).

Warren J. Ramler, "Performance Characteristics of a WIP Electron Beam System", *RadTech '88: North American Radiation Curing Conference and Exposition*, Apr. 25–29, 1988.

*Primary Examiner*—Eugene R. LaRoche
*Assistant Examiner*—Michael B. Shingleton
*Attorney, Agent, or Firm*—Thomas Schneck

[57] ABSTRACT

A wide area electron gun in which an electron beam originates from secondary emission electrons emitted by a target bombarded by ions. A cylindrical main housing has a central region where the secondary emission target is located and auxiliary housings on opposed sides of the target, outside of the main housing, contain low temperature ion plasmas. Ion beams are extracted from peripheral regions of the plasmas and enter narrow ports or slits connecting the auxiliary housings with the main housing. A higher pressure in the auxiliary housings, compared to the main housing, supports ion flow into the main housing. The ion beams have a low angle of incidence to the plane of the target and may be either slightly below or above the target. In the case the beam enters from above the target, the target is segmented, like venetian blinds. The secondary electrons exit the main housing through a foil window such that the electron beam is almost at right angles to the ion beams.

24 Claims, 3 Drawing Sheets

REMOTE ION SOURCE PLASMA ELECTRON GUN

DESCRIPTION

1. Technical Field

The invention relates to large area electron guns and more particularly to a secondary electron emission gun associated with a gas plasma.

2. Background Art

Cold cathode, secondary electron emission guns were first developed in the early 1970's for ionizing high power lasers. In French Pat. No. 72 38 368, D. Pigache describes an electron gun in which an ion source powered by filaments and magnetic fields emits an ion beam which bombards a cold cathode, emitting secondary electrons. These electrons then travel back through the ion source and exit into air through a thin metal window. The ion and electron paths are coaxial, but counterflowing due to different polarities.

In U.S. Pat. No. 3,970,892 G. Wakalopulos describes an electron gun in which a gas plasma is ionized in a manner permitting ions to be extracted from the plasma boundary to bombard a metal cathode from which the secondary electrons are emitted. The electrons flow counter to the ions and are allowed to escape through a window in a housing for the plasma and the secondary emitter.

In U.S. Pat. No. 4,025,818 R. Giguere et al. disclose a similar wide area electron gun except that the hollow cathode forming the secondary emission surface in the first mentioned patent is replaced by a wire, thereby allowing for a much more compact design.

In U.S. Pat. No. 4,642,522, Harvey et al. disclose the addition of an auxiliary grid for better control in switching an electron beam on and off.

In U.S. Pat. No. 4,645,978, Harvey et al. disclose a radial design for an ion plasma electron gun. The radial design is useful in switching large amounts of electric power.

In U.S. Pat. No. 4,694,222, Wakalopulos discloses an ion plasma electron gun which features grooves in the cathode to increase secondary electron yield.

The prior art relating to ion plasma electron guns may be summarized in a general way by observing that usually two adjacent chambers are employed in a single housing. These chambers are separated by a grid and are evacuated and backfilled with helium to a pressure of 10 to 30 millitorr. In one chamber, a plasma is established using a low voltage power supply. A high voltage negative supply at 100 to 300 kilovolts is connected to a cold cathode in the second chamber. The negative field of the cold cathode attracts and accelerates ions from the boundary of the plasma. The accelerated ions bombard the cold cathode releasing 10 to 15 secondary electrons per ion. The electrons generally travel back through a grid separating the two chambers and through the plasma. A window is provided so that the electrons can escape the plasma chamber and exit into air. The ions and electrons are traveling in counterflowing paths, with the electron distribution being directly proportional to the ion distribution. The geometry of the plasma chamber, its current density, the gas and gas pressure determine the shape and distribution of the plasma. In turn, the shape of the plasma determines the general shape of the ion and electron beams.

The grid which separates the plasma chamber from the high voltage chamber must be transparent to the electron beam and is therefore typically 80 to 90% open in area. This transparency makes the operating pressure in both chambers nearly equal, which tends to cause high voltage breakdown or arcing in the high voltage region.

In order to achieve improved electron beam uniformity and electron current densities required for commercial electron beam processing applications, i.e. 100–500 micro-amps per centimeter squared, the plasma chamber has to be operated at high pressure, i.e. 1–30 millitorr. This pressure causes the anode-cathode spacing in the high voltage chamber to decrease in order to minimize Paschen breakdown, i.e. arcing due to high gas pressure or large anode-cathode spacing. The reduced spacing requirements increase the electric field stress of the electrodes, causing a higher probability of vacuum breakdown, i.e. arcing in the vacuum due to close electrode spacing. The arcing process is undesirable because it causes current surges in the power supply and results in operational down time.

An object of the present invention was to devise a large area electron gun which has a compact geometry yet which was not subject to Paschen or vacuum breakdown. Another object was to devise a large area electron gun which had better beam control and efficiency, reliability and operational range.

DISCLOSURE OF THE INVENTION

The above objects have been achieved with the realization that in an ion plasma electron gun, the ion source could be removed from the path of the electrons so that deleterious counter-flowing streams of ions and electrons, which characterize the prior art, no longer exist. Instead, an ion source is isolated in an auxiliary housing removed from a main housing for the high voltage chamber, the two being separated by a narrow aperture. Now, a pressure differential may be maintained between the two housings so that better efficiencies are achieved. The separation of the plasma region from the electron beam formation region allows both the plasma and the electron beam to be separately shaped and controlled for optimal density, pattern and uniformity. For example, magnetic fields could be used to confine the plasma in one housing, yet not affect the electron beam which might be controlled electrostatically in another housing.

A preferred design involves a main housing with a central high voltage chamber at low pressure and peripheral or side plasma housings feeding energetic ions into the main housing by gas flow through a narrow aperture and toward an elongated metal target in the main housing. Now, an electron beam formed from secondary electron emission from the target need not penetrate the plasma nor the ion extraction grid. This allows fine mesh grids to be used for ion beam shaping, turning and focusing. The high energy electron beam will no longer destroy wire control grids since it is not coaxial with the ion beam. Other advantages of the invention will be seen below.

BEST MODE FOR CARRYING OUT THE INVENTION

Figure 1:
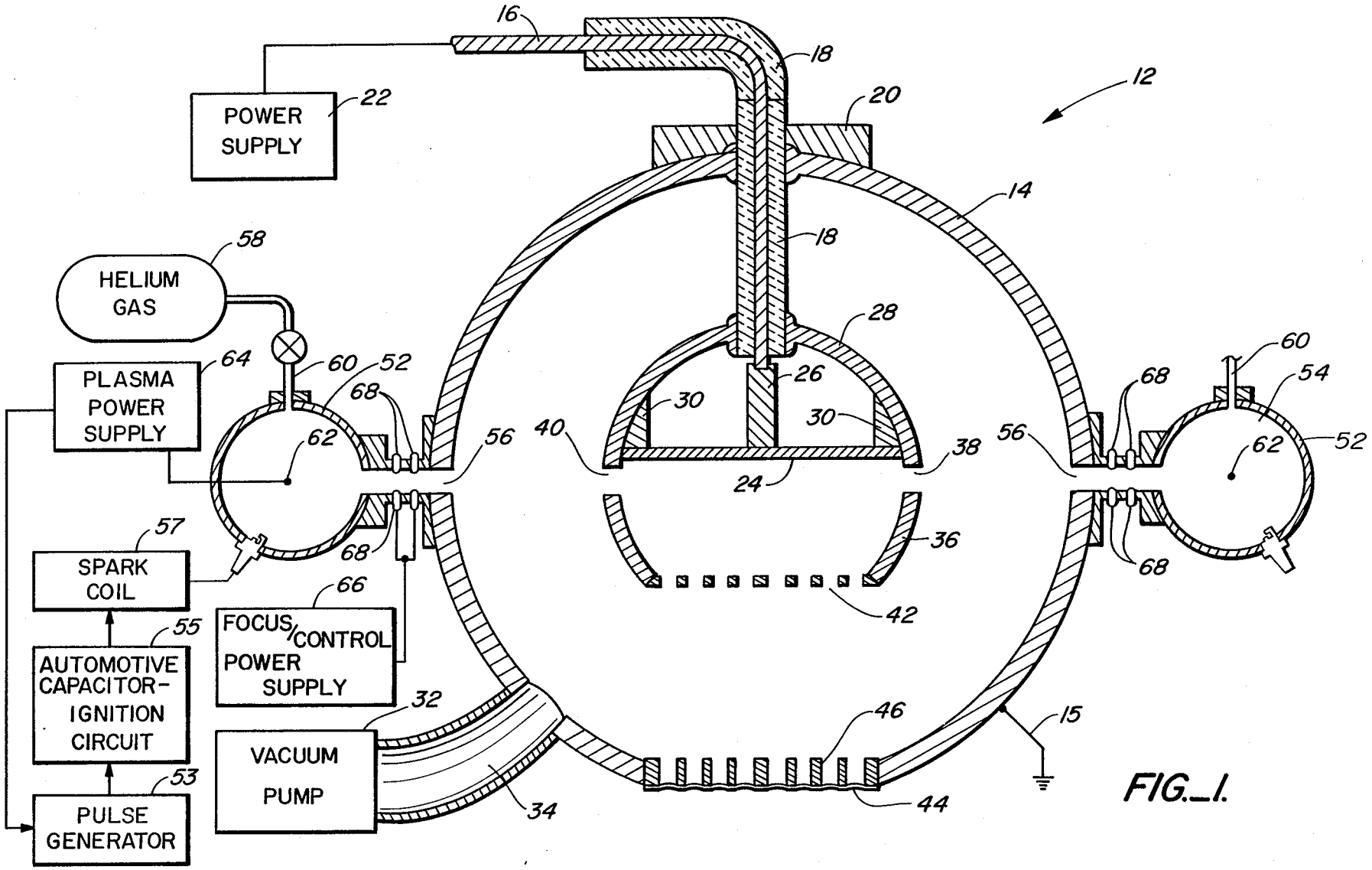
FIG. 1 is a side plan view of a remote source electron gun in accord with the present invention.

With reference to FIG. 1, a main housing 12 has a gas impermeable wall 14, seen in cross section. The wall is cylindrical, having a length of several feet, but could be shorter and could be spherical or perhaps rectangular or an asymmetric shape. A high voltage electrode 16 penetrates wall 14 and is supported within insulating sheath 18 which itself is supported by support block 20. Wall 14 is grounded by means of electrical ground 15. High voltage electrode 16 is connected to the high voltage power supply 22, capable of supplying several thousand volts for short intervals, but usually supplying a few hundred volts. Electrode 16 is connected to secondary electron emitter 24 using a cathode cable connector 26. The emitter 24 is supported within a cathode shield 28 by means of metal blocks 30.

A vacuum pump 32 communicates with main housing 12 via connecting pipe 34. Vacuum pump 32 has the capability of pumping main housing 12 down to less than 0.1 millitorr, which is a preferred condition. Pressure in the main chamber should not exceed 1.0 millitorr He.

A beam shield 36 is spaced apart from cathode shield 28 by ion entrance slits 38 and 40. Beam shield 36 has an opening distal to the secondary electron emitter 24 which is a cathode shadow grid 42. This grid is a wire mesh used for shaping an emergent electron beam which is shaped to flow toward a thin foil, forming beam window 44. The thin foil maintains the vacuum within main housing 12, yet allows penetration of an electron beam. Beam window 44 is held in place by foil backup grid 46.

Outside of the main chamber, cylindrical auxiliary chambers 52 and 54 are adjacently disposed. Each of the auxiliary chambers is connected to the main chamber by means of a connecting passageway 56. The auxiliary chamber typically has the same longitudinal extent as the main chamber. A gas supply 58 feeds the auxiliary chambers through a connecting pipe 60, opening into the auxiliary chamber. Helium is the preferred gas, introduced and maintained at a pressure in the range of 10–20 millitorr. Each chamber has an electrode 62 connected to a plasma power supply 64 capable of forming an ionized plasma from the gas delivered from gas supply 58. Typically, plasma power supply 64 consists of a current regulated positive polarity, regulated d.c. power source. The voltage needed to form a low temperature ionized plasma is usually greater than 5 kV for plasma ignition with a total current of 10 to 50 milliamps per linear inch of plasma. Once the plasma has been formed, voltage in the supply drops to several hundred volts. The operation of a low temperature plasma source is described in U.S. Pat. No. 3,156,842 to McClure. Briefly, if electrode 62 is formed into a thin wire, electrons are caused to orbit about the wire in long paths. The energetic electrons ionize the gas and maintain a discharge process. Positive ions are accelerated towards the walls of the auxiliary chambers 52 and 54 where they liberate secondary electrons. A control and focus power supply 66 maintains voltages on control electrodes 68 surrounding passageway 56. It is well known that cold cathode plasma discharge characteristics change with time. Oxide coatings and other insulating impurities greatly increase the secondary electron emission and this facilitates plasma ignition and maintenance. However, after a long operating time, the continuous ion bombardment generally removes all impurities from the inside of the plasma chamber walls. The result of such atomically clean surfaces is reduced electron emission. Thus a higher current is necessary for plasma maintenance and higher starting voltages are required to ignite the plasma. Voltages as high as 20 KV may be used or a hot filament electron source has been successful.

To overcome this problem without the use of a hot filament, a spark ignition system is used. A spark plug 51 is installed on the side or end of the plasma ion source. It is connected to the plasma power supply by a pulse generator 53, an automotive capacitor ignition circuit 55, and a spark coil 57. The spark plug is fired every time this plasma is switched on. This will facilitate plasma formation and make it independent of operation time. The ions and electrons produced by the spark easily ignite the plasma. The location of the spark source is important in plasma ignition. Generally, it is more efficient to locate the spark plug at an end of the plasma, near the termination of wire 62, where it can inject axial electrons into the plasma chamber.

To eliminate the sensitivity to spark location, a wide area spark source is used. These wide area plasma sources emit electrons over a wide linear dimension and thus help in uniform plasma formation. The use of ceramics to facilitate surface discharges also aid in the generation of wide area electron sources. Many plasma formation techniques are possible due to the remote location of the plasma source. The absence of high energy electrons facilitates the placement of insulators in the plasma region.

Finally, the spark source can be pulsed continuously from 100 to 300 Hertz to also help in maintaining the discharge. This mode of operation requires less plasma current since the spark source provides free electrons to keep the discharge going.

The spark source may be either a spark plug, which is a point spark source, or may be a wide area spark source. In the situation where a spark plug is used, spark plug 51 is mounted near the termination of wire 62. The endwise injection of electrons encourages the formation of spiral electron orbits about wire 62. As the electrons traverse the wire in a helical path, coaxial with the wire, gas atoms in the chamber are ionized. The spark plug could be located elsewhere in the auxiliary chamber, but the formation of helical electron trajectories about the wire would be more difficult to establish.

Figure 2:
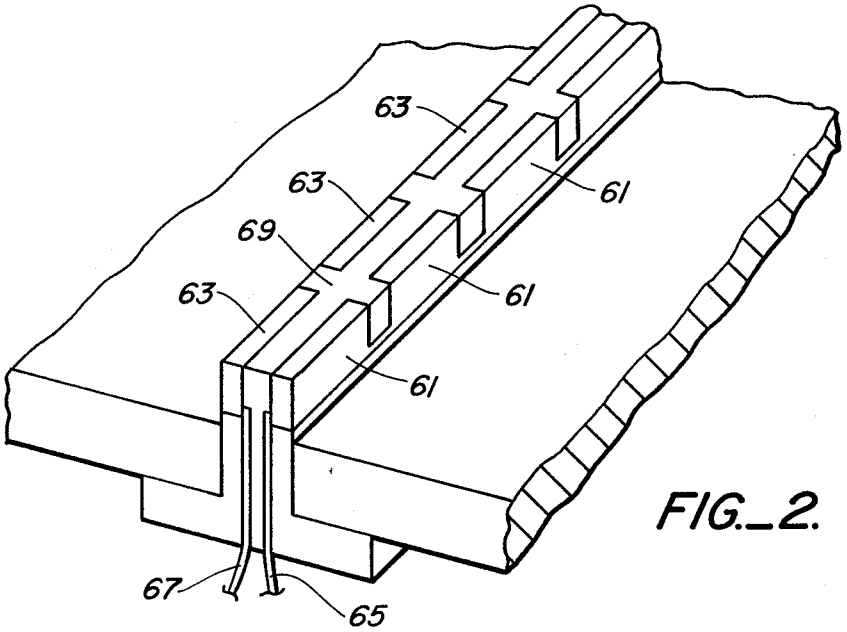
FIG. 2 is a detail of a spark plate ignition source for an ion chamber of FIG. 1.

In FIG. 2, a wide area spark source 51 is shown which would be mounted along the length of the auxiliary chamber, parallel with wire 62. The extended spark source 51 would be fed from a spark coil adjacent to the spark plug source. A series of metal plates 61, spaced apart by insulative gaps 69 would form a continuous first electrode at high potential fed by wire 65. A second sequence of spaced apart electrodes 63 would be maintained at ground potential by wire 67. The material of gap 69 may be alumina or similar ceramic material. The theory of operation is similar to a spark plug wherein a high voltage arcs across gap 69 from the high voltage plates to ground potential. Electrons formed along the length of the wide area source migrate toward the high voltage wire and begin orbiting the wire after collisions with gas atoms between the outer wall of the chamber and the central wire.

Returning to FIG. 1, once a plasma is formed in the auxiliary chambers, ions are extracted from the periphery of the plasma by the electrodes 68 and travel through the passageway 56 into the main chamber. The ions are focused both by the electrodes and by the strong high voltage field in the main chamber. Ions are directed towards the cathode shield 28 which is maintained at a high negative potential because of contact with secondary electron emitter 24. The ions pass through elongated ion entrance slits 38 and 40 because of alignment of the passageways 56 with the secondary electron emitter 24. The emitter is typically molybdenum metal, but other materials could also be used. Once ions strike the secondary electron emitter, electrons are energetically released from the emitter surface and move towards cathode shadow grid 42 and thence toward beam window 44. Ion trajectories inside of the beam shield can be modified by allowing more or less electric field penetration through the cathode shadow grid 42.

The secondary electron yield of molybdenum bombarded by 200 kV helium ions is approximately 10 to 15 electrons per incident ion at 0° incidence angle from normal. At 30° incidence angle, the yield doubles and at 80° to 90° incidence angle (grazing incidence), the yield is a factor of 3 to 4 higher. The efficiency is thus enhanced by bombarding the target at steep incidence angles of approximately 70° to 90°. This may be done in a manner discussed below with reference to FIG. 3. In accord with the present invention, the main ion beams from the auxiliary chambers are transverse to the electron beam formed from electrons emitted from the secondary emitter. In FIG. 1, there is an approximate right angle relationship between the ion beam coming from sides of the main chamber and the electron beam which is emitted downwardly from the main chamber. The secondary electrons leave the target surface with 10 to 50 volts of energy and then follow field lines inside of beam shield 36. It is important to adjust the distance from the secondary emitter 24 to the cathode shadow grid 42. This distance, along with the grid transparency and the geometry of the ion passageway, determines the field inside of beam shield 36. The field must be stronger in the vicinity of the cathode shadow grid 42 to make the electrons travel in that direction. If the ion aperture field is stronger, the electrons will loop back to the ion source. Although, all electrons leaving the cathode surface initially travel in paths normal to the surface.

Electrons which leave the surface of the secondary electron emitter 24 are then accelerated towards the cathode shadow grid 42 where they attain their maximum speed. The cathode shadow grid 42 is aligned with the foil backup grid 46 in order to minimize electron interception by the foil backup structure. The electron beam thus has a shadow of the cathode grid and exits into air outside of the main chamber through the thin beam window 44 without hitting the foil backup grid 46. The electrons are then directed to a deposition surface where they may induce chemical change, such as curing of polymeric material or any other desired use. The electron beam may be made uniform across beam window 44 for wide processing applications, namely in the situation where main housing 12 is a cylinder.

Figure 3:
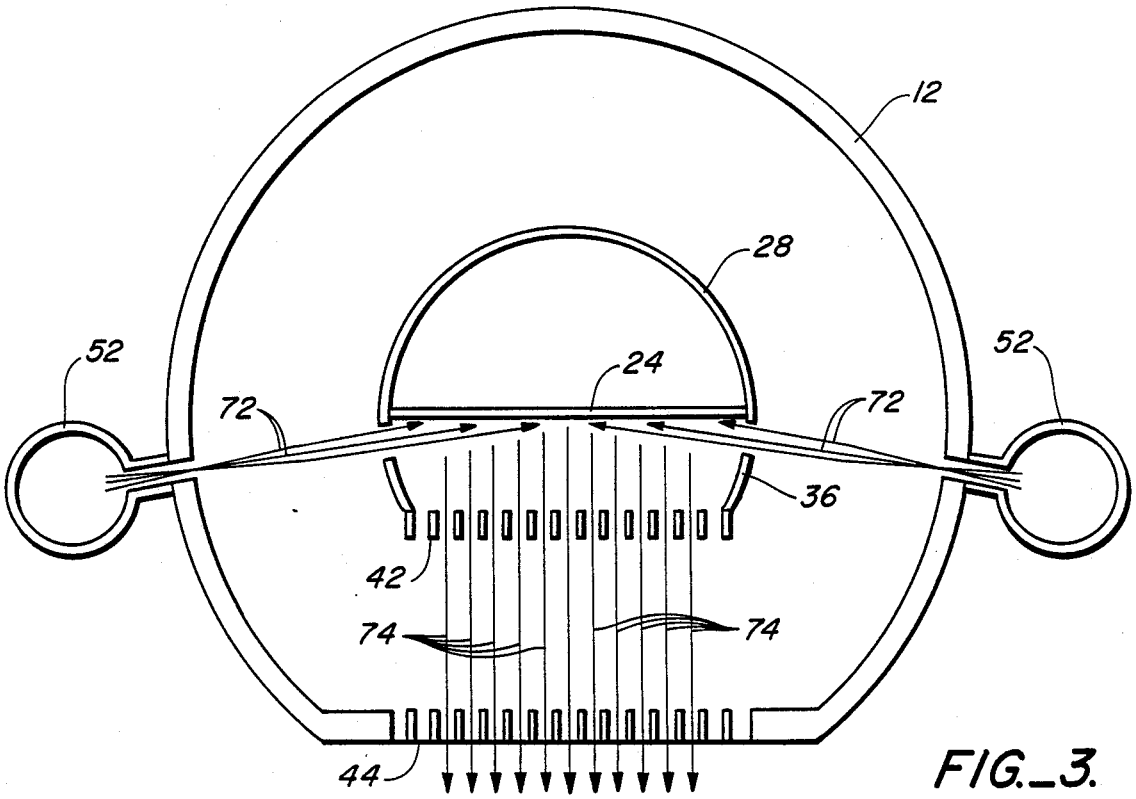
FIG. 3 is a first embodiment of a secondary emission electrode structure used in the apparatus of FIG. 1.
Figure 4:
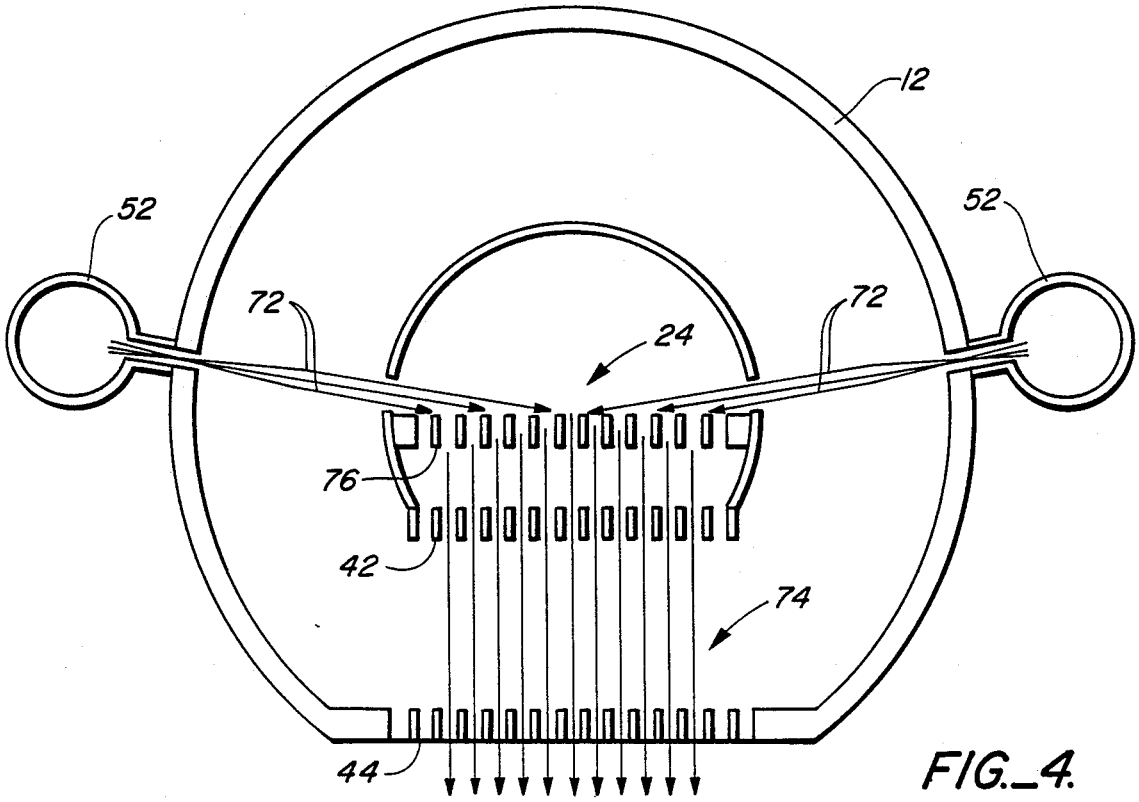
FIG. 4 is a second embodiment of a secondary emission electrode structure used in the apparatus of FIG. 1.

With reference to FIGS. 3 and 4, ion and electron beam trajectories may be seen. In FIG. 2, ionized plasmas exist in auxiliary chambers 52. Ion beams are formed therein and pass through passageways into main housing 12 where electric fields guide the ion beams 72 towards secondary electron emitter 24 after the beams enter the aperture defined between the cathode shield 28 and the beam shield 36. In both FIGS. 2 and 3 it is seen that the ion beam 72 is at approximate right angles to the electron beam 74. In FIG. 2, the ion beam is at less than a right angle to the electron beam, while in FIG. 4 it is at slightly more than a right angle. Usually, the ion beam is within plus or minus 30° to the plane of the secondary electron emitter 24, and preferably within plus or minus eight degrees. Actually, the secondary electron emitter need not be a plane, but may be segmented in a discontinuous manner, as explained below.

In FIG. 3, the ion beam emerging from the auxiliary chamber on the right controls the right portion of the electron beam 74 passing through the right side of the beam window 44. Similarly, the ion beam on the left controls the left portion of the electron beam 74. The distribution of ions within each ion beam can be matched or staggered so that at the secondary emitter the valley of one beam covers the peak of its neighbor and vice versa. This geometry allows for uniform electron beams covering a wide area.

Besides the angular variation of the ion beam, FIG. 4 illustrates that the secondary emitter may be formed by a plurality of spaced apart parallel ribs 76. In this manner, the top surface of the ribs is almost parallel to the incident ion beams, thereby promoting higher secondary emission efficiency. Emitted electrons travel through the ribs toward cathode shadow grid 42 with a higher electron flux than in the embodiment of FIG. 3. Moreover, the location of the ion beam 72 above the plane of the ribs 76 has an advantage where access into the main housing 12 is difficult.

While electrostatic focusing was discussed for forming the ion and electron beams, one might substitute magnetic focusing electrodes for the electrostatic electrodes. In the event that main housing 12 is spherical, the auxiliary housing 52 may be made toroidal. Where the main housing 12 is cylindrical, auxiliary housings 52 are also cylindrical. Pressure in auxiliary housings 52 is always higher than in main housing 12 so that the pressure differential encourages ion flow from the auxiliary housing into the main housing. Even though the main force on the beams is electrostatic or magnetic, the pressure differential also encourages beam formation.

Figure 5A:
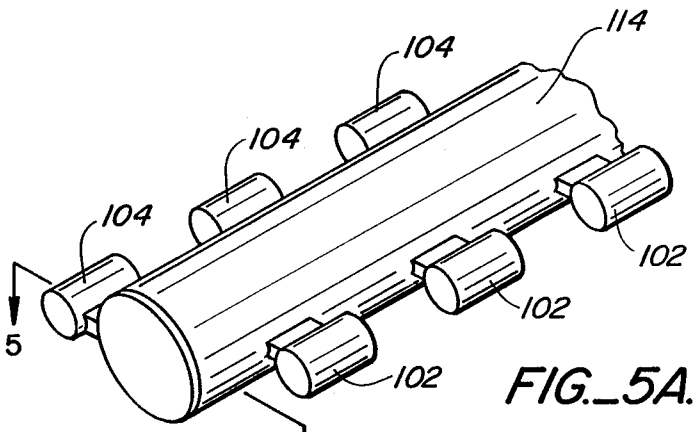
FIG. 5A is an isometric view of an elongated ion gun of the present invention.
Figure 5:
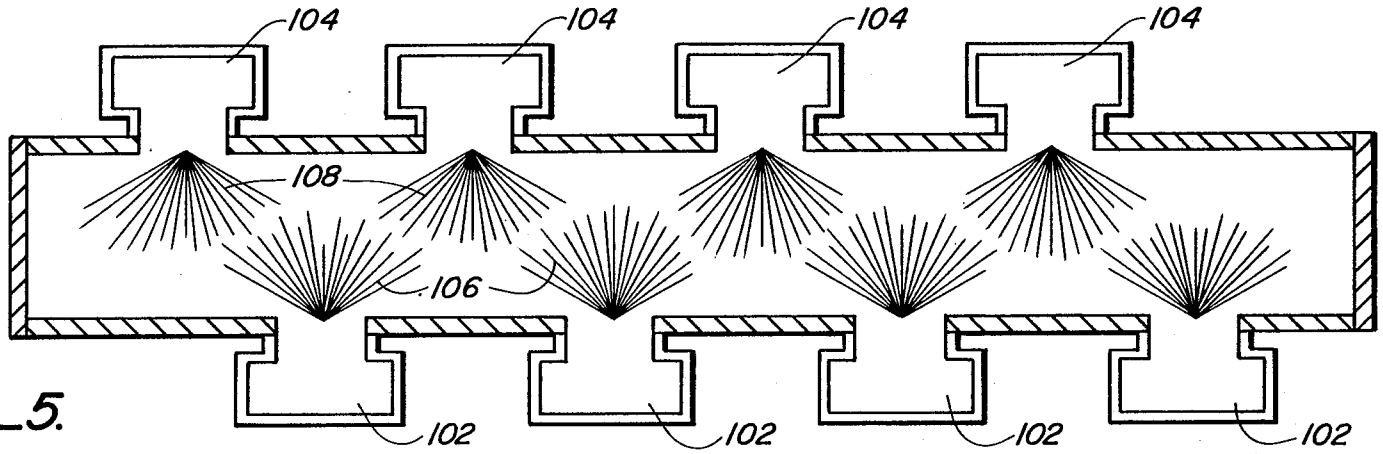
FIG. 5 is a cross sectional view of an ion gun configuration taken along lines 5—5 in FIG. 5A.

FIGS. 5 and 5A show an arrangement of auxiliary chambers 102 on one side of main chamber 114 and other auxiliary chambers 104 on the opposite side of the chamber. Auxiliary chambers 102 are offset from chambers 104 such that ion beams 106 overlap with ion beams 108. At the center of the main chamber 114 the overlapping beams form a generally uniform plasma. An advantage of the configuration of FIG. 5 is that a very long electron source may be constructed, without the need for long, continuous ion sources. Instead, a plurality of offset, relatively small size, ion sources may be disposed on each side of the central chamber 114. The width of each auxiliary source should be sufficient to produce a generally uniform plasma at the center of the main chamber 114.

I claim:

1. A wide area, ion plasma electron gun comprising, a main housing having a central region and peripheral gas impermeable wall regions, with an electron beam permeable window disposed in said peripheral wall regions, and means for establishing a first pressure therein below atmospheric pressure, a high voltage region disposed centrally in said main housing, the high voltage region having a high voltage electrode penetrating the wall of the main housing and having a secondary emission target of elongated cross section connected to the high voltage electrode, an auxiliary housing adjacent to said main housing and connected thereto by a passageway, said auxiliary housing having means for forming a plasma and means for establishing a second pressure therein below atmospheric pressure, said second pressure greater than said first pressure, said passageway having means for defining an ion beam trajectory having an angle of incidence of 70° to 90° at the face of the secondary emission target in the high voltage region of the main housing, said target emitting secondary electrons at high angles to said ion beam trajectory, said main housing having beam forming means for directing said secondary electrons through said window onto a wide area deposition zone.

2. The apparatus of claim 1 wherein said passageway comprises an elongated slit generally shielding said plasma from said high voltage region.

3. The apparatus of claim 1 wherein said means for defining an ionic trajectory comprises magnetic field means for focusing said ion beam.

4. The apparatus of claim 1 wherein said means for defining an ionic trajectory comprises electrostatic field means for focusing said ion beam.

5. The apparatus of claim 1 wherein said beam forming means comprises a wire grid disposed in said central region of the main housing.

6. The apparatus of claim 1 wherein a plurality of auxiliary housings are disposed adjacent to said main housing and connected thereto by a passageway, each auxiliary housing having means for confining an ionized plasma and means for establishing a second pressure therein below atmospheric pressure, said second pressure greater than said first pressure, said passageway having means for defining an ion beam trajectory having a low angle of incidence toward the secondary emission target in the high voltage region of the main housing, said target emitting secondary electrons at substantial angles to said ion beam trajectory, said main housing having beam forming means for directing said secondary electrons through said window.

7. The apparatus of claim 1 wherein said target comprises a plurality of parallel, spaced apart, metal ribs.

8. The apparatus of claim 1 wherein said beam forming means comprises a plurality of rows of parallel, spaced apart, metal ribs.

9. The apparatus of claim 1 wherein said main housing is cylindrical.

10. The apparatus of claim 1 wherein said auxiliary housing is cylindrical and having a gas supply vessel connected thereto.

11. The apparatus of claim 1 wherein said first pressure is less than 1.0 millitorr.

12. The apparatus of claim 1 wherein said second pressure is in the range of 10 to 20 millitorr.

13. The apparatus of claim 6 further defined wherein said main housing is cylindrical, having a lengthwise axis, and a plurality of auxiliary housings are disposed on opposite sides of said main housing and offset from each other along the lengthwise extent of said axis.

14. A wide area electron gun comprising, a main housing having a central region and peripheral gas impermeable wall regions, with an electron beam permeable window disposed in said peripheral wall regions, and means for establishing a first pressure therein below atmospheric pressure, a high voltage region disposed in said central region in said main housing, the high voltage region having a high voltage electrode penetrating the wall of the main housing and having a secondary emission target of extended cross section connected to the high voltage electrode, means for forming ion beams at spaced apart, opposed regions outside of said gas impermeable wall regions of said main housing, said wall regions defining a pair of spaced apart opposed apertures in positions whereby said high voltage electrode attracts said ion beams into the main housing in the direction of said target at angles of incidence of approximately 70° or greater thereto, said target emitting secondary electrons at substantial angles to said ion beams, said main housing having beam forming means for directing said secondary electrons through said window onto a wide area deposition zone.

15. The apparatus of claim 14 wherein said secondary emission target is discontinuous, having a plurality of spaced apart target members.

16. The apparatus of claim 15 wherein said target comprises a plurality of parallel, spaced apart, metal ribs.

17. The apparatus of claim 14 wherein said beam forming means comprises a plurality of rows of parallel, spaced apart, metal ribs.

18. The apparatus of claim 14 wherein said main housing is cylindrical, having a lengthwise axis, and having a plurality of auxiliary housings disposed on opposite sides of the main housing and offset from each other along the lengthwise extent of said axis, said auxiliary housings containing said means for forming ion beams.

19. The apparatus of claim 14 wherein said means for forming a pair of ion beams comprises means for ionizing a gas plasma and electrode means for shaping a stream of ions emerging from the plasma.

20. The apparatus of claim 19 wherein said plasma is a low temperature plasma.

21. A method of forming a wide area electron beam comprising, disposing a secondary emission target over an area, directing an ionic beam at an angle of incidence of at least 70° toward the target, forming an electron beam from secondary emission electrons emitted from the target, directing said electron beam from the target at a substantial angle to said ionic beam in a pattern having a wide area at a deposition zone.

22. The method of claim 21 further defined by disposing said target in a main chamber and forming said ionic beam from a plasma disposed in an auxiliary chamber communicating with the main chamber.

23. The method of claim 21 further defined by guiding said electron beam by electrostatic focusing.

24. The method of claim 21 further defined by forming the ionic beam from helium molecules.

* * * * *